US009011173B2

(12) United States Patent
Osada et al.

(10) Patent No.: US 9,011,173 B2
(45) Date of Patent: Apr. 21, 2015

(54) MULTI-CONNECTED CONNECTOR

(75) Inventors: Takeshi Osada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/883,147

(22) PCT Filed: Jan. 19, 2012

(86) PCT No.: PCT/JP2012/051583

§ 371 (c)(1),
(2), (4) Date: May 2, 2013

(87) PCT Pub. No.: WO2012/099274

PCT Pub. Date: Jul. 26, 2012

(65) Prior Publication Data

US 2013/0288517 A1 Oct. 31, 2013

(30) Foreign Application Priority Data

Jan. 19, 2011 (JP) ..... 2011-009133

(51) Int. Cl.

| | |
|---|---|
| ***H01R 13/60*** | (2006.01) |
| ***H01R 13/514*** | (2006.01) |
| ***H01R 13/518*** | (2006.01) |
| ***H01R 13/641*** | (2006.01) |

(52) U.S. Cl.

CPC ..... *H01R 13/514* (2013.01); *H01R 13/518* (2013.01); *H01R 13/641* (2013.01)

USPC ..... 439/527

(58) Field of Classification Search

USPC ..... 439/527, 701, 540.1, 638–640, 364, 439/352–353

See application file for complete search history.

(56) References Cited

U.S. PATENT DOCUMENTS

| | | | | |
|---|---|---|---|---|
| 4,997,386 | A * | 3/1991 | Kawachi et al. | 439/352 |
| 5,454,733 | A | 10/1995 | Watanabe et al. | |
| 5,545,053 | A * | 8/1996 | Ishii et al. | 439/364 |

(Continued)

FOREIGN PATENT DOCUMENTS

| | | | |
|---|---|---|---|
| EP | 1 662 618 | A1 | 5/2006 |
| JP | 2799444 | B2 | 9/1998 |
| JP | 2008-66122 | A | 3/2008 |

OTHER PUBLICATIONS

International Search Report and Written Opinion of the International Search Report for PCT/JP2012/051583 dated Apr. 25, 2012.

(Continued)

*Primary Examiner* — Jean F Duverne
(74) *Attorney, Agent, or Firm* — Kenealy Vaidya LLP

(57) ABSTRACT

A multi-connected connector 1 includes a plurality of first connectors 110*a*, 110*b*, 110*c* and 110*d* and a second connector 20 having a plurality of connector fitting chambers 21*a*, 21*b*, 21*c*, 21*d* arranged in a row in a transverse direction to fit the first connectors. The first connectors include a connector whose length is different from the other connector of the first connectors in a fitting direction of the first connectors. Butting walls 22*a*, 22*b*, 22*c*, 22*d* as positioning parts that determine fitting completed positions of the first connectors respectively in the connector fitting chambers 21*a*, 21*b*, 21*c*, 21*d* are arranged in accordance with lengths in the fitting direction of the first connectors to be connected so that rear end surfaces of the plurality of first connectors which are normally completely fitted are aligned so as to be flush.

1 Claim, 11 Drawing Sheets

(56) References Cited

U.S. PATENT DOCUMENTS

| | | | | | |
|---|---|---|---|---|---|
| 5,638,824 | A | * | 6/1997 | Summers | 600/437 |
| 5,679,028 | A | * | 10/1997 | Yagi et al. | 439/701 |
| 5,775,953 | A | * | 7/1998 | Yamanashi et al. | 439/701 |
| 5,797,757 | A | * | 8/1998 | Aoki | 439/101 |
| 6,191,672 | B1 | * | 2/2001 | Lages et al. | 335/202 |
| 6,659,810 | B2 | * | 12/2003 | Okabe et al. | 439/701 |

OTHER PUBLICATIONS

Korean Office Action for the related Korean Patent Application No. 10-2013-7018930 dated Jun. 25, 2014.
Korean Office Action for the related Korean Patent Application No. 10-2013-7018930 dated Feb. 9, 2015.
Chinese Office Action for the related Chinese Patent Application No. 201280005781.2 dated Feb. 2, 2015.

* cited by examiner

MULTI-CONNECTED CONNECTOR

TECHNICAL FIELD

The present invention relates to a multi-connected connector that a plurality of first connectors are fitted and attached to a second connector under a state that the plurality of first connectors are arranged in one row in a transverse direction.

BACKGROUND ART

FIG. 6 shows a usual example of a multi-connected connector directly attached to a printed circuit board. The multi-connected connector 100 is disclosed in a below-described PTL 1 and includes a plurality of first connectors 110 and a second connector 120 to which the first connectors 110 are fitted and attached.

The second connector 120 is provided, as shown in the drawing, in a form that a plurality of connector fitting chambers 121 are arranged in a row in a transverse direction. Each of the connector fitting chambers 121 is a part to which the first connector 110 is fitted and attached.

Further, in the case of the multi-connected connector 100 shown in FIG. 6, the second connector 120 is provided with a simultaneous fitting detecting member 130. The simultaneous fitting detecting member 130 is a member that simultaneously pushes in rear ends of the plurality of first connectors 110 temporarily attached to the connector fitting chambers 121 respectively to their normal fitting completed positions. The simultaneous fitting detecting member 130 has one end side connected to the second connector 120 so as to freely rotate by a hinge 131 and is pressed respectively to the rear ends of the first connectors 110 by a rotating operation.

When all of the plurality of first connectors 110 are pushed in to the normal fitting completed positions by a pushing-in operation of the simultaneous fitting detecting member 130, an engaging hook 132 provided in the other end of the simultaneous fitting detecting member 130 is engaged with an engaging part provided in the second connector 120, so that the simultaneous fitting detecting member 130 is fixed to a rear end of the second connector.

Namely, in the multi-connected connector 100, when a part of the first connectors 110 are located in a half inserted state that the first connectors 110 do not reach the normal fitting completed positions, the engaging hook 132 of the simultaneous fitting detecting member 130 is not engaged with the engaging part of the second connector 120 side. Thus, it can be detected whether or not the first connectors are located in the half inserted state in accordance with that state.

In the case of the multi-connected connector 100 shown in FIG. 6, forms and dimensions of all the plurality of first connectors 110 attached to the second connector 120 are the same. However, the multi-connected connector may include such structures as shown in FIG. 7 and FIG. 8.

A multi-connected connector 100A shown in FIG. 7 and FIG. 8 includes a plurality of first connectors 110*a*, 110*b*, 110*c* and 110*d* and a second connector 120A to which the first connectors 110*a*, 110*b*, 110*c* and 110*d* are fitted and attached.

The second connector 120A is provided, as shown in the drawing, in a form that a plurality of connector fitting chambers 121*a*, 121*b*, 121*c* and 121*d* are arranged in a row in a transverse direction. The connector fitting chambers 121*a*, 121*b*, 121*c* and 121*d* are respectively parts to which the first connectors 110*a*, 110*b*, 110*c* and 110*d* are fitted and attached.

The plurality of first connectors 110*a*, 110*b*, 110*c* and 110*d* are different in their dimension of width due to the difference of the number of accommodated connecting terminals or the forms of terminals.

Further, in the first connector 110*c*, a length in a fitting direction is shorter than those of other first connectors 110*a*, 110*b* and 110*d*.

Further, as shown in FIG. 9, in the connector fitting chambers 121*a*, 121*b*, 121*c* and 121*d* of the second connector 120A respectively, butting walls 122*a*, 122*b*, 122*c* and 122*d* are provided.

The butting walls 122*a*, 122*b*, 122*c* and 122*d* are positioning parts on which end surfaces of the first connectors 110*a*, 110*b*, 110*c* and 110*d* abut to determine fitting completed positions of the first connectors 110*a*, 110*b*, 110*c* and 110*d*.

In the case of the usual multi-connected connector, the above-described butting walls 122*a*, 122*b*, 122*c* and 122*d* are arranged in a row in a transverse direction so as to align their positions as shown in FIG. 9.

Accordingly, when all the first connectors 110*a*, 110*b*, 110*c* and 110*d* are pushed in to normal fitting competed positions, as shown in FIG. 10, a rear end of the first connector 110*c* whose length in the fitting direction is smaller is more recessed by the difference L1 of fitting length than rear ends of other first connectors 110*a*, 110*b* and 110*d*

On the other hand, when the first connector 110*c* whose length in the fitting direction is smaller is located in a half inserted state, and when other first connectors 110*a*, 110*b* and 110*d* are located in completely inserted states where the first connectors are inserted to the normal fitting completed positions, the recessed part of the first connector 110*c* whose length in the fitting direction is smaller is more reduced than that in a normal case, or as shown in FIG. 11, the rear end 110*c* is aligned with the positions of the rear ends of the other first connectors 110*a*, 110*b* and 110*d*.

CITATION LIST

Patent Literature

[PTL 1] JP-A-2008-66122

SUMMARY OF INVENTION

Technical Problem

However, as disclosed in the PTL 1, in the multi-connected connector 100 in which the plurality of first connectors 110 are pushed in relative to the second connector 120 to the normal fitting completed positions by the simultaneous fitting detecting member 30, there is possibility in that the structure of the connector is complicated due to an equipment of the simultaneous fitting detecting member 30 to increase a cost.

Further, as shown in FIG. 9, in the case of the multi-connected connector 100A in which the butting walls 122*a*, 122*b*, 122*c* and 122*d* provided in the connector fitting chambers 121*a*, 121*b*, 121*c* and 121*d* of the second connector 120A are arranged in a row in the transverse direction so as to align their positions, when a part of the plurality of first connectors 110*a*, 110*b*, 110*c* and 110*d* respectively fitted and attached to the connector fitting chambers 121*a*, 121*b*, 121*c* and 121*d* includes a connector whose length is different in the fitting direction, the position of the rear end of the connector whose length in the fitting direction is shorter is more recessed than those of other connectors.

However, when the plurality of first connectors whose lengths in the fitting direction are different are located in half inserted states at the same time, a plurality of positions arise where the rear positions are misaligned. Thus, the connectors located in the half inserted states are occasionally hardly discriminated only by external appearances.

The present invention has been made in view of these situations and possibility. It is an object of the present invention to provide a multi-connected connector which can simply discriminate whether or not a plurality of first connectors multi-connected to a second connector are located in half inserted states only by an external appearance without using a special member and can reduce a cost by simplifying a structure.

Solution to Problem

The above-described object of the present invention is achieved by a below-described structure.

(1) A multi-connected connector, comprises a plurality of first connectors, and a second connector having a plurality of connector fitting chambers arranged in a row in a transverse direction to fit the first connectors, wherein the plurality of first connectors include a connector whose length is different from the other connector of the first connectors in a fitting direction of the first connectors, and positioning parts that determine fitting completed positions of the first connectors are respectively provided in the connector fitting chambers and arranged in accordance with lengths in the fitting direction of the first connectors to be connected so that rear end surfaces of the plurality of first connectors that are normally completely fitted are aligned so as to be flush.

In the structure of the above-described (1), when all the first connectors are pushed in to the normal fitting completed positions in the second connector, the rear end surfaces of all the first connectors are aligned so as to be flush irrespective of the difference in length in the fitting direction of the first connectors.

In other words, in the first connector which is half inserted to the second connector, the rear end surface protrudes more than the positions of the rear end surfaces of other first connectors which are completely inserted to the second connector irrespective of the length of the connector in the fitting direction.

Accordingly, in the plurality of first connectors arranged in one row in the transverse direction on the second connector, when external appearances are merely compared as to whether or not the rear end surface protrudes more than those of other first connectors, the presence or absence of the half inserted state can be simply discriminated without using a special member.

Further, since the special member such as the simultaneous fitting detecting member is not used to discriminate whether or not the half inserted state is present, a cost can be reduced by simplifying the structure of the connector.

Advantageous Effects of Invention

According to the multi-connected connector of the present invention, in the first connector which is half inserted to the second connector, the rear end surface protrudes more than the positions of the rear end surfaces of other first connectors which are completely inserted to the second connector irrespective of the length of the connector in the fitting direction.

Accordingly, in the plurality of first connectors arranged in one row in the transverse direction on the second connector, when external appearances are merely compared as to whether or not the rear end surface protrudes more than those of other first connectors, the presence or absence of the half inserted state, can be simply discriminated without using a special member.

Further, since the special member such as the simultaneous fitting detecting member is not used to discriminate whether or not the half inserted state is present, a cost can be reduced by simplifying the structure of the connector.

DESCRIPTION OF EMBODIMENTS

Figure 1:
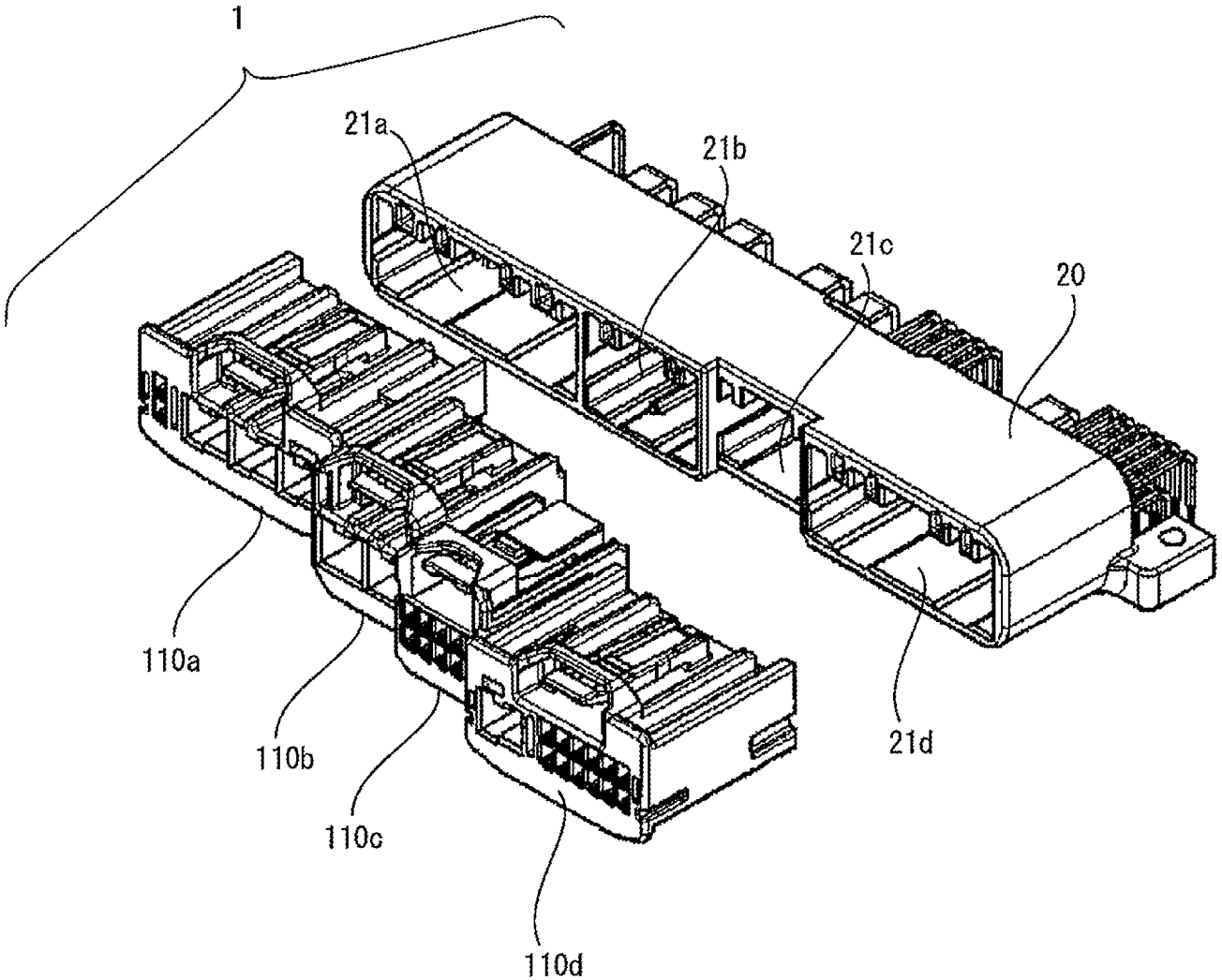
FIG. 1 is an exploded perspective view of one exemplary embodiment of a multi-connected connector according to the present invention.

Now, a preferred exemplary embodiment of a multi-connected connector according to the present invention will be described below in detail by referring to the drawings.

FIGS. 1 to 5 show one exemplary embodiment of a multi-connected connector according to the present invention. FIG. 1 is an exploded perspective view of one exemplary embodiment of the multi-connected connector according to the present invention.

Figure 2:
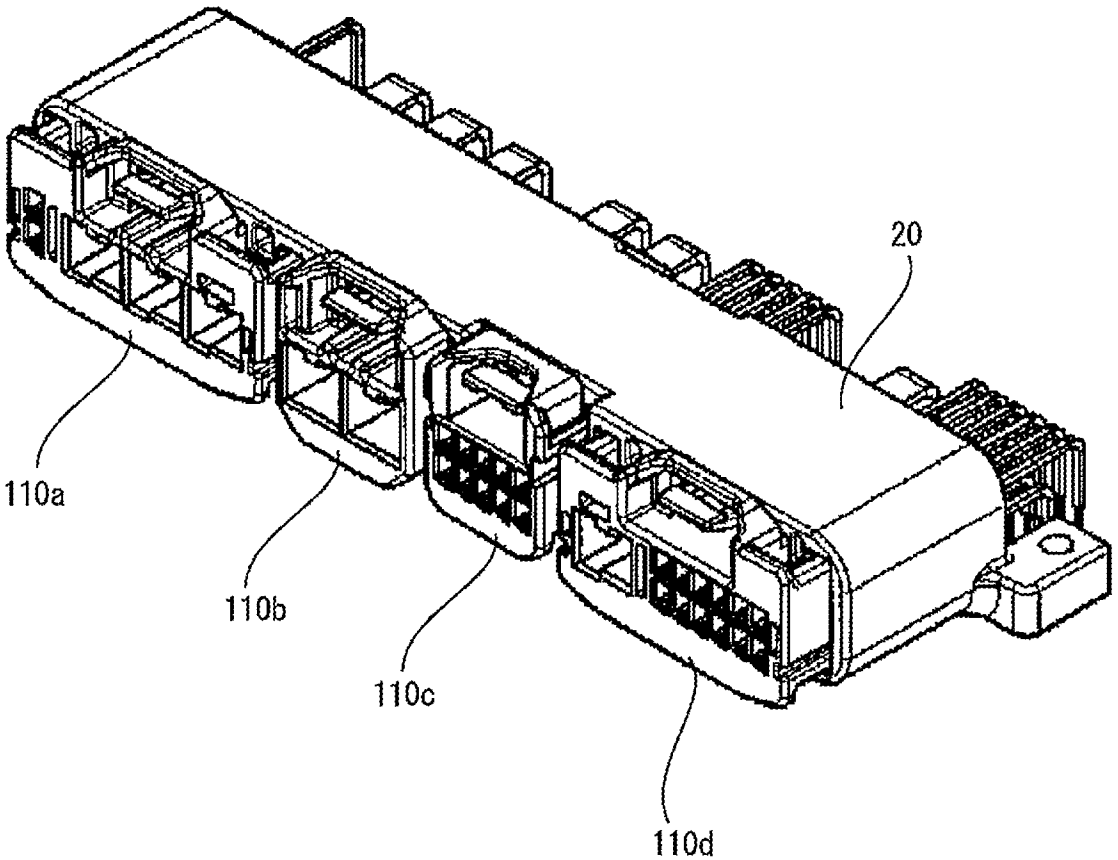
FIG. 2 is a perspective view of an assembled state of the multi-connected connector shown in FIG. 1.
Figure 3:
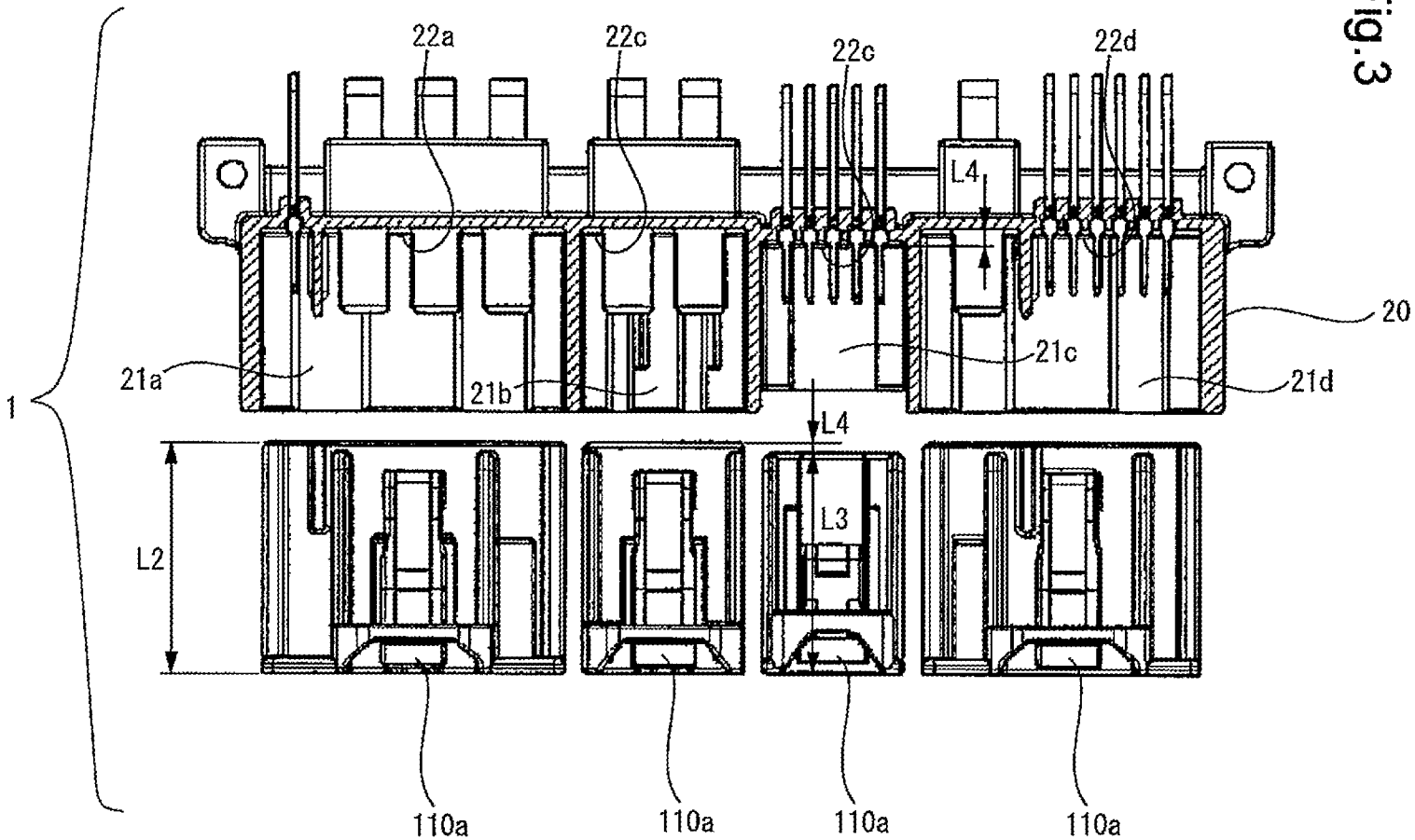
FIG. 3 is a horizontally sectional view showing a second connector shown in FIG. 1 and a plurality of first connectors attached to the second connector.
Figure 4:
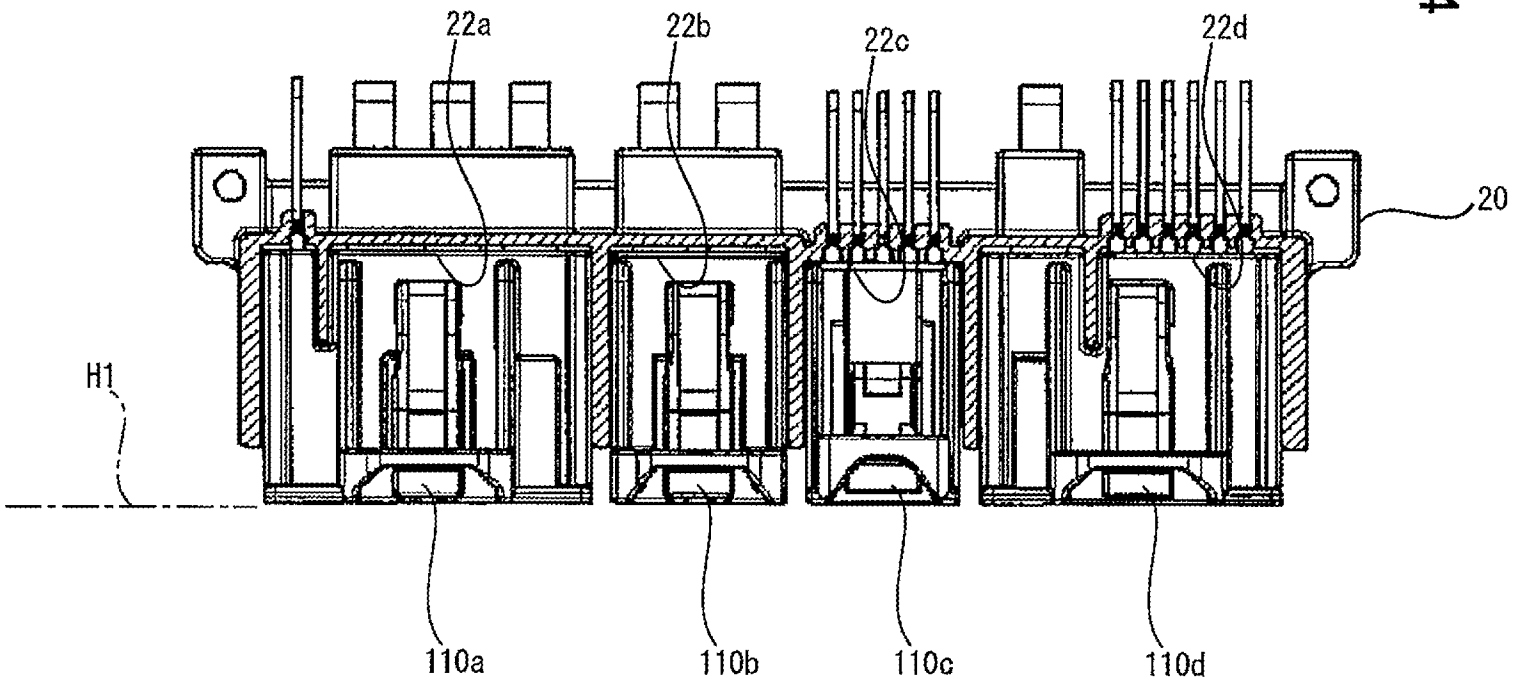
FIG. 4 is a horizontally sectional view showing a state that the plurality of first connectors are fitted and attached to the second connector shown in FIG. 3 and all the first connectors are located in completely inserted states.
Figure 5:
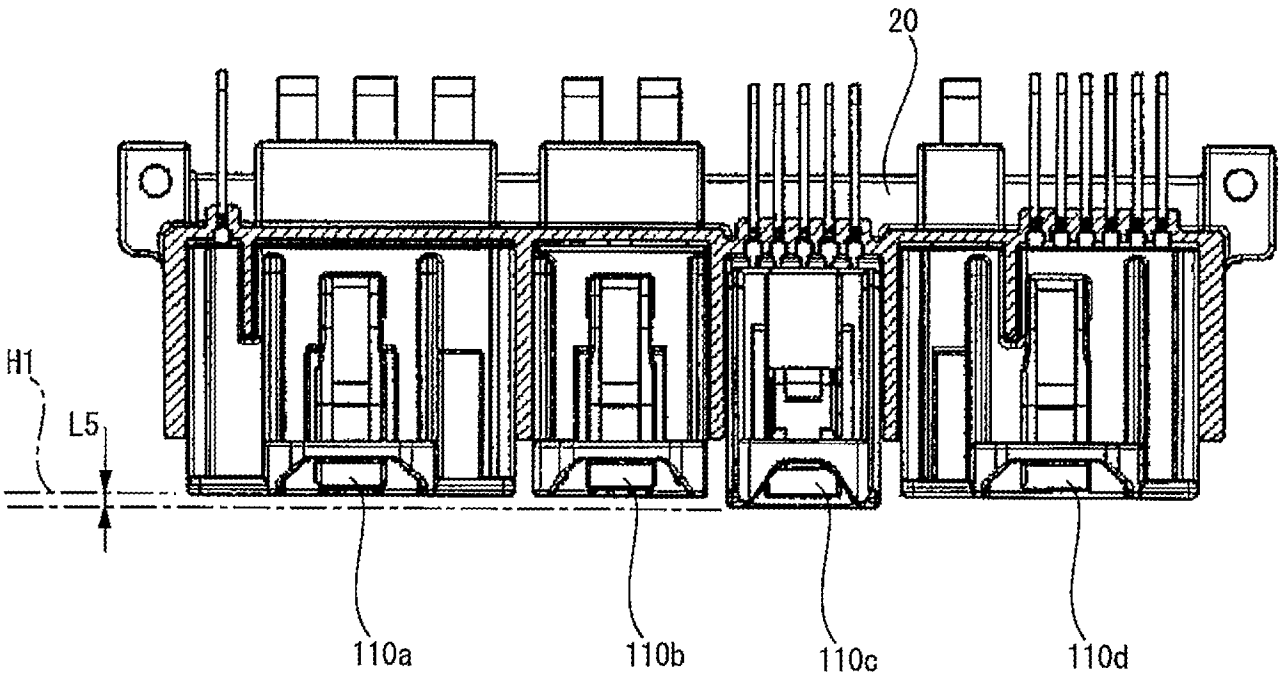
FIG. 5 is a horizontally sectional view showing a state that the plurality of first connectors are fitted and attached to the second connector shown in FIG. 3 and only the first connector whose length in a fitting direction is shorter is located in a half inserted state.
Figure 6:
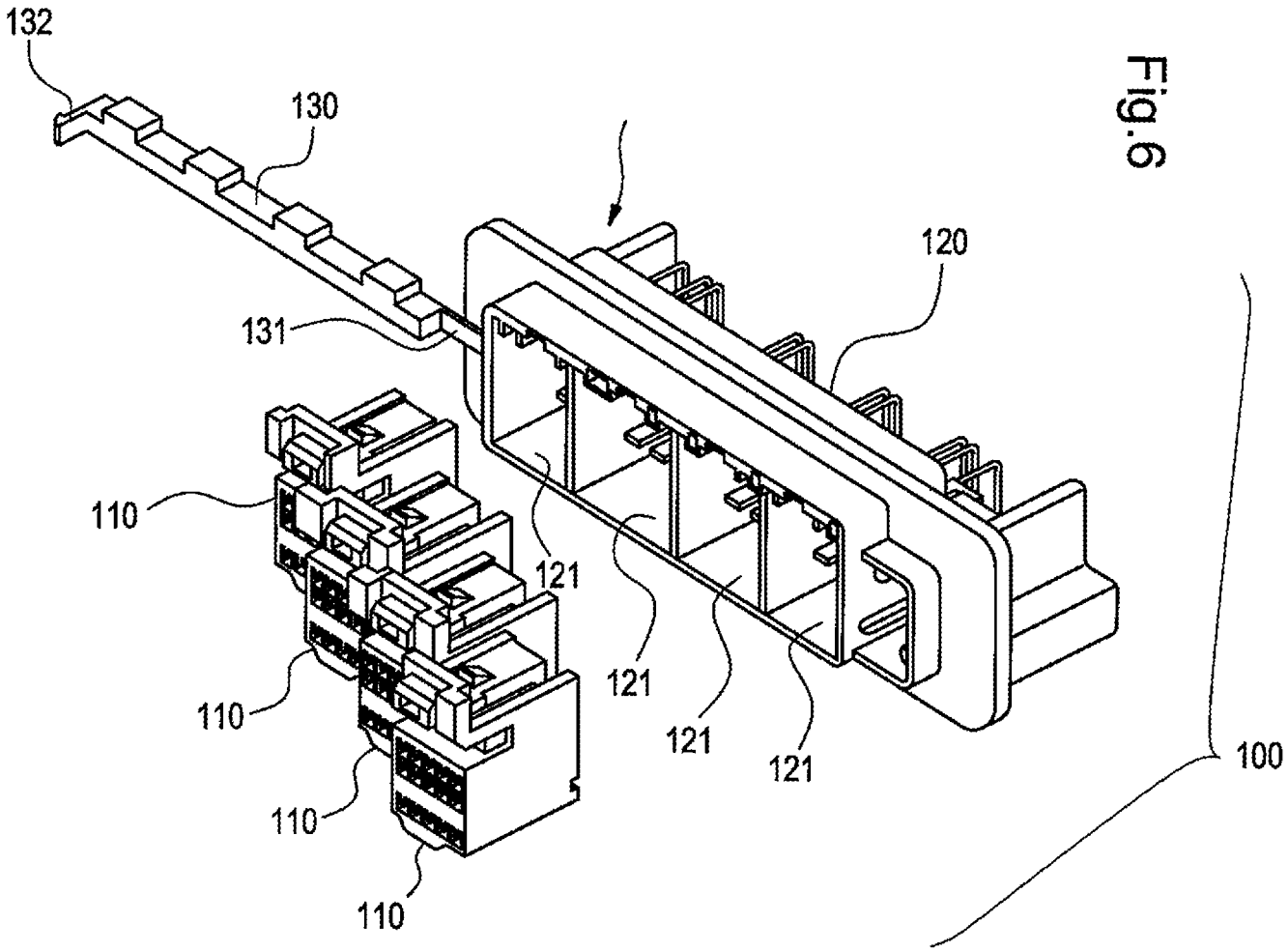
FIG. 6 is an exploded perspective view of a usual multi-connected connector.

FIG. 2 is a perspective view of an assembled state of the multi-connected connector shown in FIG. 1. FIG. 3 is a horizontally sectional view showing a second connector shown in FIG. 1 and a plurality of first connectors attached to the second connector. FIG. 4 is a horizontally sectional view showing a state that the plurality of first connectors are fitted and attached to the second connector shown in FIG. 3 and all the first connectors are located in completely inserted states. FIG. 5 is a horizontally sectional view showing a state that the plurality of first connectors are fitted and attached to the second connector shown in FIG. 3 and only the first connector whose length in a fitting direction is shorter is located in a half inserted state.

Figure 7:
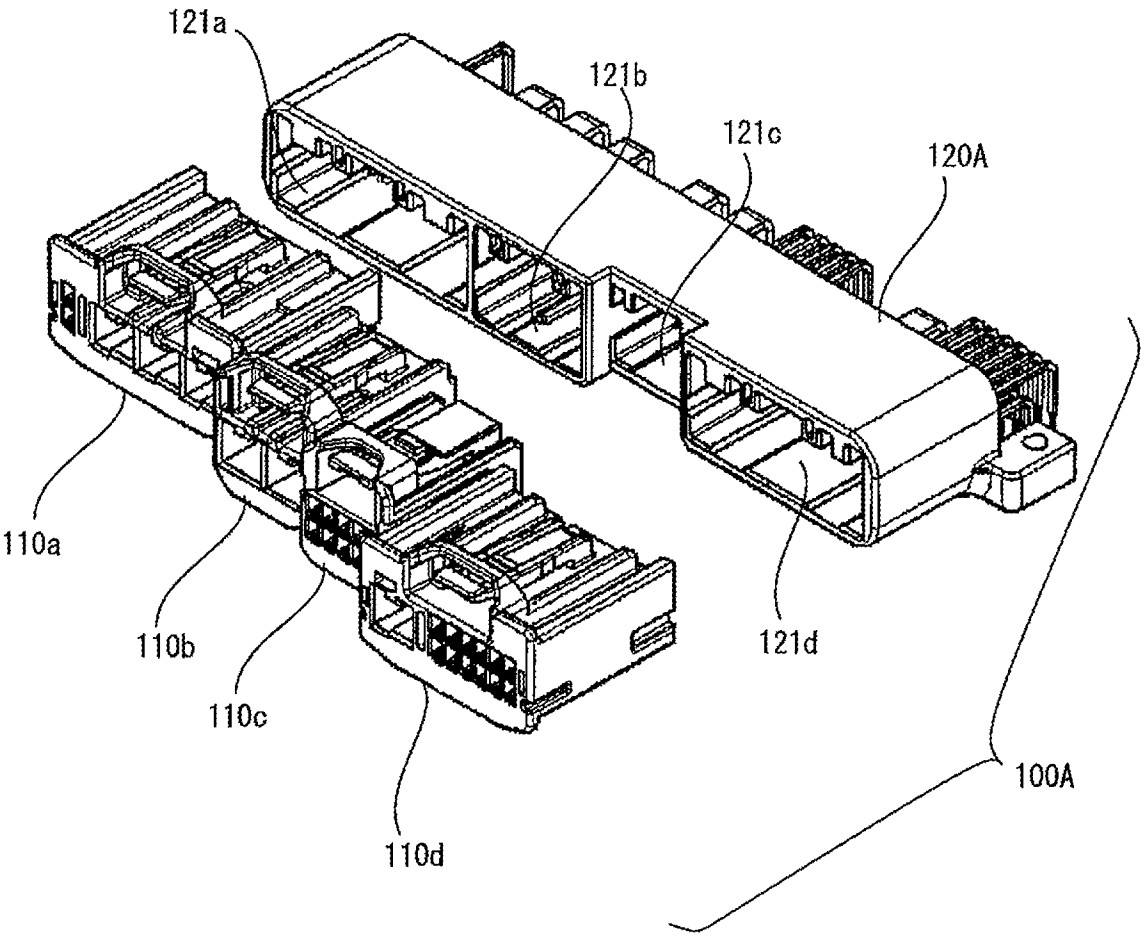
FIG. 7 is an exploded perspective view of another usual multi-connected connector.
Figure 8:
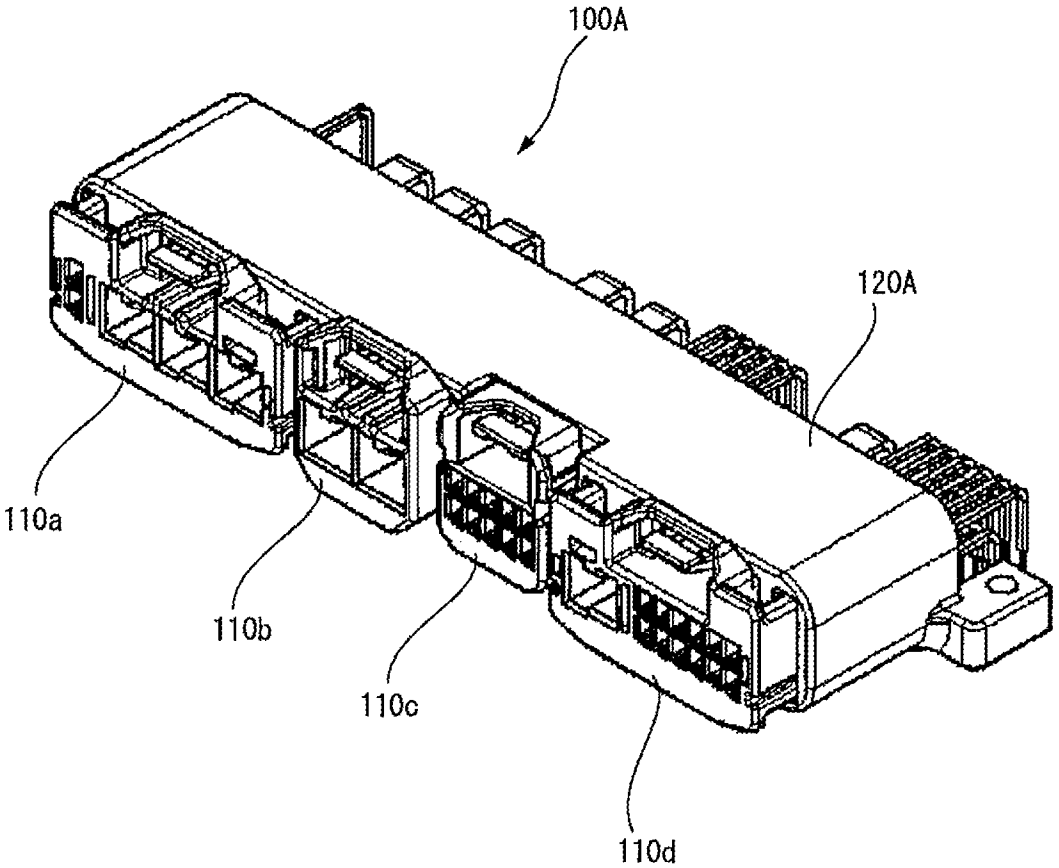
FIG. 8 is a perspective view of an assembled state of the multi-connected connector shown in FIG. 7.
Figure 9:
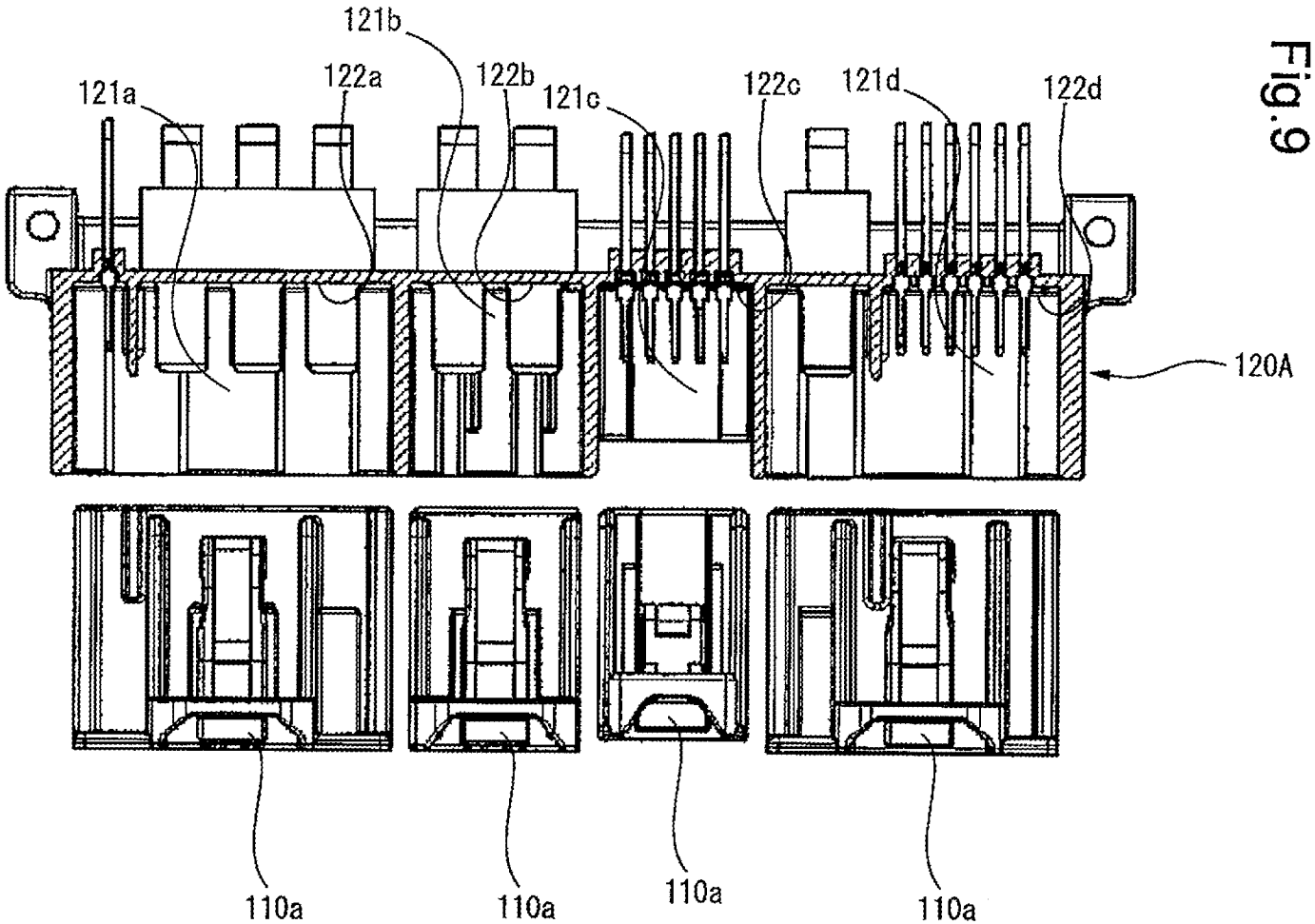
FIG. 9 is a horizontally sectional view showing a second connector shown in FIG. 7 and a plurality of first connectors attached to the second connector.
Figure 10:
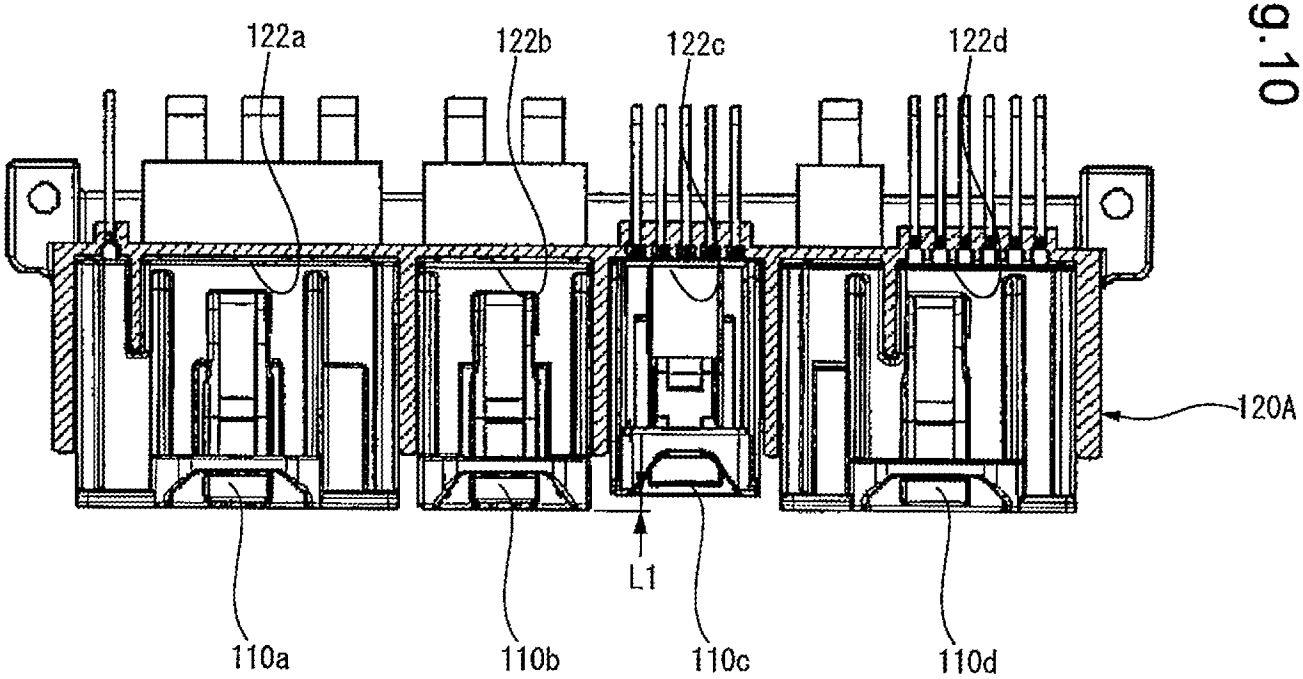
FIG. 10 is a horizontally sectional view showing a state that the plurality of first connectors are fitted and attached to the second connector shown in FIG. 9 and all the first connectors are located in completely inserted states.
Figure 11:
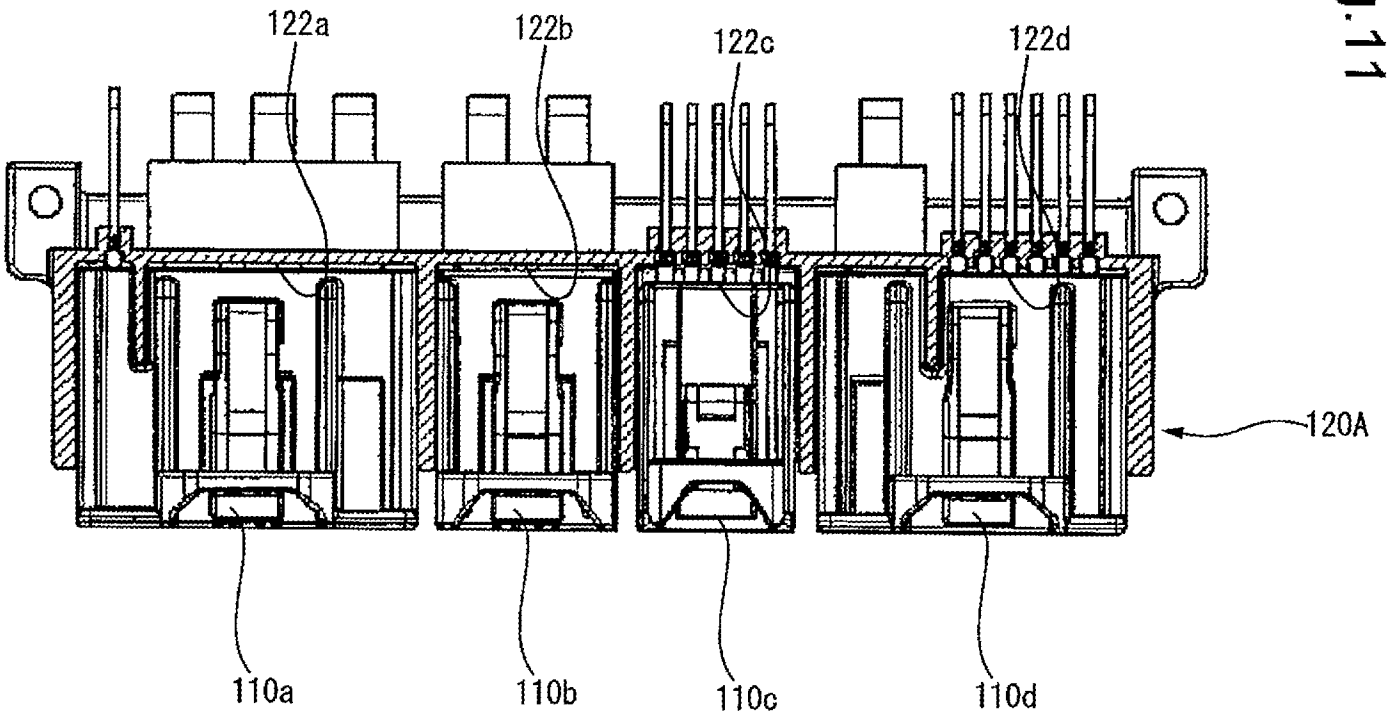
FIG. 11 is a horizontally sectional view showing a state that the plurality of first connectors are fitted and attached to the second connector shown in FIG. 9 and only the first connector whose length in a fitting direction is shorter is located in a half inserted state.

The multi-connected connector 1 of one exemplary embodiment is formed by improving the multi-connected connector 100A shown in FIG. 7 and FIG. 8 and includes four first connectors 110*a*, 110*b*, 110*c* and 110*d* and a second connector 20 to which the four first connectors 110*a*, 110*b*, 110*c* and 110*d* are fitted and attached.

The second connector 20 is provided, as shown in FIG. 1, in a form that a plurality of connector fitting chambers 21*a*, 21*b*, 21*c* and 21*d* are arranged in a row in a transverse direction. The connector fitting chambers 21*a*, 21*b*, 21*c* and 21*d* are respectively parts to which the first connectors 110*a*, 110*b*, 110*c* and 110*d* are fitted and attached.

The plurality of first connectors 110*a*, 110*b*, 110*c* and 110*d* are different in their dimension of width due to the difference of the number of accommodated connecting terminals or the forms of terminals.

Further, in the first connector 110*c*, a length in a fitting direction is shorter than those of other first connectors 110*a*, 110*b* and 110*d*. Namely, the plurality of first connectors attached to the second connector 20 include connectors whose lengths in a fitting direction are different from each other.

Specifically, as shown in FIG. 3, in all of the three first connectors 110*a*, 110*b* and 110*d*, the lengths in the fitting direction are set to L2. As compared therewith, in the shorter first connector 110*c*, the length in the fitting direction is set to L3. As shown in FIG. 3, a difference between the length L3 and L2 is L4.

Further, as shown in FIG. 3, in the connector fitting chambers 21*a*, 21*b*, 21*c* and 21*d* of the second connector 20 respectively, butting walls 22*a*, 22*b*, 22*c* and 22*d* are provided.

The butting walls 22*a*, 22*b*, 22*c* and 22*d* are positioning parts on which end surfaces of the first connectors 110*a*, 110*b*, 110*c* and 110*d* abut to determine fitting completed positions of the first connectors 110*a*, 110*b*, 110*c* and 110*d*.

In the case of the multi-connected connector 1 of the present exemplary embodiment, the butting walls 22*a*, 22*b*, 22*c* and 22*d* are arranged, as shown in FIG. 4, in accordance with the lengths in the fitting direction of the first connectors to be connected so that rear end surfaces of the plurality of first connectors 110*a*, 110*b*, 110*c* and 110*d* which are normally completely fitted are respectively aligned so as to be flush with a reference surface position H1.

Namely, in the case of the present exemplary embodiment, the butting wall 22*c* which positions the shorter first connector 110*c* is arranged, as shown in FIG. 3, so as to protrude more to the first connector side by the difference L4 in length in the fitting direction between the first connector 110*c* and other first connectors than other butting walls 22*a*, 22*b* and 22*d*.

Accordingly, when the first connector 110*c* whose length in the fitting direction is smaller is located in a half inserted state, and when other first connectors 110*a*, 110*b* and 110*d* are located in completely inserted states where the first connectors are inserted to normal fitting completed positions, as shown in FIG. 5, the rear end of the first connector 110*c* protrudes more by an insufficient insertion L5 than the positions (the reference surface position H1) of the rear ends of other first connectors 110*a*, 110*b* and 110*d*. Thus, the half inserted state of the first connector 110*c* can be simply discriminated from an external appearance.

In the multi-connected connector 1 of the above-described exemplary embodiment, when all the first connectors 110*a*, 110*b*, 110*c* and 110*d* are pushed in to the normal fitting completed positions in the second connector 20, as shown in FIG. 4, the rear end surfaces of all the first connectors 110*a*, 110*b*, 110*c* and 110*d* are aligned so as to be flush irrespective of the difference in length in the fitting direction of the first connectors 110*a*, 110*b*, 110*c* and 110*d*.

In other words, in the first connector which is half inserted to the second connector 20, as shown in FIG. 5, the rear end surface protrudes more than the positions of the rear end surfaces of other first connectors 1 which are completely inserted to the second connector 20 irrespective of the length of the connector in the fitting direction.

Accordingly, in the plurality of first connectors 110*a*, 110*b*, 110*c* and 110*d* arranged in one row in the transverse direction on the second connector 20, when external appearances are merely compared as to whether or not the rear end surface protrudes more than those of other first connectors, the presence or absence of the half inserted state can be simply discriminated without using a special member.

Further, since the special member such as the simultaneous fitting detecting member is not used to discriminate whether or not the half inserted state is present, a cost can be reduced by simplifying the structure of the connector.

The multi-connected connector of the present invention is not limited to the above-described exemplary embodiment, and a suitable modification and an improvement may be made.

For instance, the number of the first connectors fitted and attached to the second connector is not limited to the above-described exemplary embodiment. Further, the present invention may be applied to a case in that a plurality of connectors fitted and attached to the second connector include three or more kinds of connectors having different lengths in a fitting direction.

Further, specific forms of positioning parts that determine the fitting completed positions of the first connectors in the connector fitting chambers are not limited to the butting walls shown in the above-described exemplary embodiment. For instance, a positioning part may include a partly protruding part.

This application is based upon and claims the benefit of priority of Japanese Patent Application No. 2011-009133 filed on Jan. 19, 2011, the contents of which are incorporated herein by reference.

INDUSTRIAL APPLICABILITY

According to the present invention, in the first connector which is half inserted to the second connector, the rear end surface protrudes more than the positions of the rear end surfaces of other first connectors which are completely inserted to the second connector irrespective of the length of the connector in the fitting direction.

Accordingly, in the plurality of first connectors arranged in one row in the transverse direction on the second connector, when external appearances are merely compared as to whether or not the rear end surface protrudes more than those of other first connectors, the presence or absence of the half inserted state can be simply discriminated without using a special member.

REFERENCE SIGN LIST

1 . . . multi-connected connector
20 . . . second connector
21*a*, 21*b*, 21*c*, 21*d* . . . connector fitting chamber
22*a*, 22*b*, 22*c*, 22*d* . . . butting wall (positioning part)
110*a*, 110*b*, 110*c* and 110*d* . . . first connector

The invention claimed is:

1. A multi-connected connector, comprising:

a plurality of first connectors; and a second connector having a plurality of connector fitting chambers and a plurality of butting walls, the plurality of connector fitting chambers arranged in a row in a transverse direction to fit the plurality of first connectors in the row, and each of the plurality of fitting chambers ends at a respective one of the butting walls;

wherein the plurality of first connectors include a connector whose length is different from another connector of the plurality of first connectors in a fitting direction of the first connectors; and wherein each of the plurality of butting walls is arranged in accordance with lengths in the fitting direction of the first connectors so that rear end surfaces of the plurality of first connectors are aligned so as to be flush with each other if each of the plurality of first connectors abuts a respective one of the plurality of butting walls.

* * * * *